US006338479B1

(12) United States Patent
Van Der Werff et al.

(10) Patent No.: US 6,338,479 B1
(45) Date of Patent: Jan. 15, 2002

(54) IN-LINE PROCESSING OF FLAT OBJECTS

(75) Inventors: Jeichienus Adriaan Van Der Werff, Montfoort; René Van Den Berg, Drachten, both of (NL)

(73) Assignee: Neopost B.V., Drachten (NL)

( * ) Notice: Subject to any disclaimer, the term of this patent is extended or adjusted under 35 U.S.C. 154(b) by 0 days.

(21) Appl. No.: 09/223,788

(22) Filed: Dec. 31, 1998

(30) Foreign Application Priority Data

Dec. 31, 1997 (NL) ..... 1007942

(51) Int. Cl.[7] ..... B65H 5/22

(52) U.S. Cl. ..... 271/3.01; 271/256; 271/258.02; 271/69

(58) Field of Search ..... 271/3.01, 3.05, 271/3.06, 121, 256, 258.01, 258.02, 69, 176, 182, 266

(56) References Cited

U.S. PATENT DOCUMENTS 5,584,472 A 12/1996 Hidding et al.

FOREIGN PATENT DOCUMENTS

| | | |
|---|---|---|
| EP | 0 303 276 | 2/1989 |
| EP | 0 491 507 | 6/1992 |
| FR | 2 644 443 | 9/1990 |

*Primary Examiner*—David H. Bollinger
(74) *Attorney, Agent, or Firm*—Burns, Doane, Swecker & Mathis, L.L.P.

(57) ABSTRACT

In the in-line processing of flat objects ($S_1$–$S_7$), the flat objects ($S_1$–$S_7$) are fed from a device (4) and serially transferred to a downstream system (5). In the system (5) the objects ($S_1$–$S_7$) are transported and, if necessary, temporarily collected. The temporary collection of specimens of the objects ($S_1$–$S_7$) occurs in a configuration with a pitch in the direction of transport which is smaller than the dimensions in the direction of transport of the objects ($S_1$–$S_7$) in question. Then collected objects ($S_1$–$S_7$) are moved away from each other, from that configuration, and further transported with mutual interspaces. Because the flat objects ($S_1$–$S_7$) are stored with a pitch less than the size in the direction of transport, a large number of objects ($S_1$–$S_7$) can be collected in a buffer portion (34, 35; 134; 234) of a small length. Because the objects ($S_1$–$S_7$) are stored with a pitch in the direction of transport, however, they can be readily moved away from each other.

16 Claims, 5 Drawing Sheets

IN-LINE PROCESSING OF FLAT OBJECTS

FIELD AND BACKGROUND OF THE INVENTION

This invention relates to a method and to a system for in-line processing flat objects.

Such a method and such a system are known from U.S. Pat. No. 5,584,472. In this patent specification, it is proposed to print sheets in a printer and to transport sheets dispensed serially by the printer via a buffer station to downstream processing stations. By printing and finishing sheets in-line, an operation and a possible source of errors in the form of the batchwise transfer of printed sheets to a finishing system is skipped. The buffer station here makes it possible, if the printer temporarily operates faster than the processing stations, or if the processing stations are temporarily stopped and the printer continues to run for some time, to temporarily store printed sheets in a buffer stock in the form of a stack.

A drawback of this device is that collecting printed documents into a stack and separating documents again requires relatively costly and sensitive equipment and in itself also constitutes a source of malfunctions.

Also in various other combinations of devices (such as collecting stations and reading stations) with downstream finishing systems, a problem frequently presenting itself is that the upstream device sometimes dispenses objects that cannot be directly processed by the downstream finishing system because the latter is at a standstill or is processing supplied objects with a frequency which is at least temporarily lower than the frequency with which these are dispensed by the upstream device.

SUMMARY OF THE INVENTION

It is an object of the invention to provide a possibility for temporarily buffering flat objects between a device that dispenses the objects and downstream transport facilities, allowing the flat objects, with simple facilities, to be reliably stored and subsequently dispensed serially.

This object is achieved, according to the present invention, by carrying out a method for in-line processing objects wherein the objects are fed from a device; at least one leading specimen of the objects is serially transferred to a system for processing serially received flat objects with a pitch between successive specimens of the objects which is greater than or equal to the dimensions in the direction of transport of the specimens in question of the objects; the at least one leading specimen of the objects is transported in the system; and at least two specimens of the objects that follow the at least one leading specimen of the objects are temporarily collected, wherein temporarily collecting the at least two specimens of the objects occurs in a configuration staggered with respect to each other in the direction of transport with a pitch in the direction of transport, which pitch is smaller than the dimensions in the direction of transport of the specimens in question of the objects; and the collected specimens of the objects are subsequently moved away from each other, from that configuration, in the order in which these specimens of the objects have been collected, and are further transported with mutual interspaces.

For carrying out such a method, in cooperation with a device that dispenses flat objects, the invention further provides a system for in-line processing flat objects serially received from an upstream device, having a transport path having an entrance for serially receiving flat objects coming from an upstream system, having a path monitoring and having a buffer portion upstream of the path monitoring; and control means operatively connected to the transport path for controlling the transport path, wherein the control means and the buffer portion are arranged for controlling the buffer portion of the transport path, such that flat objects in the buffer portion are collected in a configuration staggered with respect to each other in the direction of transport, with a pitch in the direction of transport which is shorter than the dimensions in the direction of transport of the flat objects in question, and for moving the collected flat objects away from each other, from that configuration, in the order in which the collected flat objects have been collected, and transporting the collected flat objects further with mutual interspaces.

Because the flat objects are temporarily stored at a pitch smaller than the size of those objects in the direction of transport, a large number of specimens of the flat objects can be collected in a buffer portion of a small length, but because the specimens are stored with a pitch in the direction of transport, they can easily be moved away from each other again.

Examples of flat objects that can be advantageously processed with the method and the system according to the invention are: sheets of paper or other material, such as plastic, cards, envelopes which may or may not be filled, quires, and booklets.

A particular advantage of the invention is that it further makes it possible to temporarily store in a compact manner flat objects in turn consisting of a plurality of stacked sheets or the like, which may or may not be bonded together, and subsequently to move these away from each other again for further processing. Because the objects are stored so as to be staggered relative to each other in the direction of transport, they can be simply treated separately again without sheets of a stack being moved away from each other.

Further objects, embodiments, details and advantages of the invention are apparent from the following description, in which reference is made to the accompanying drawings.

DETAILED DESCRIPTION

The invention is first elucidated further with reference to the exemplary embodiment illustrated in FIGS. 1–7, which is currently preferred most. Then, by way of example, a few alternative possibilities will be discussed.

Figure 1:
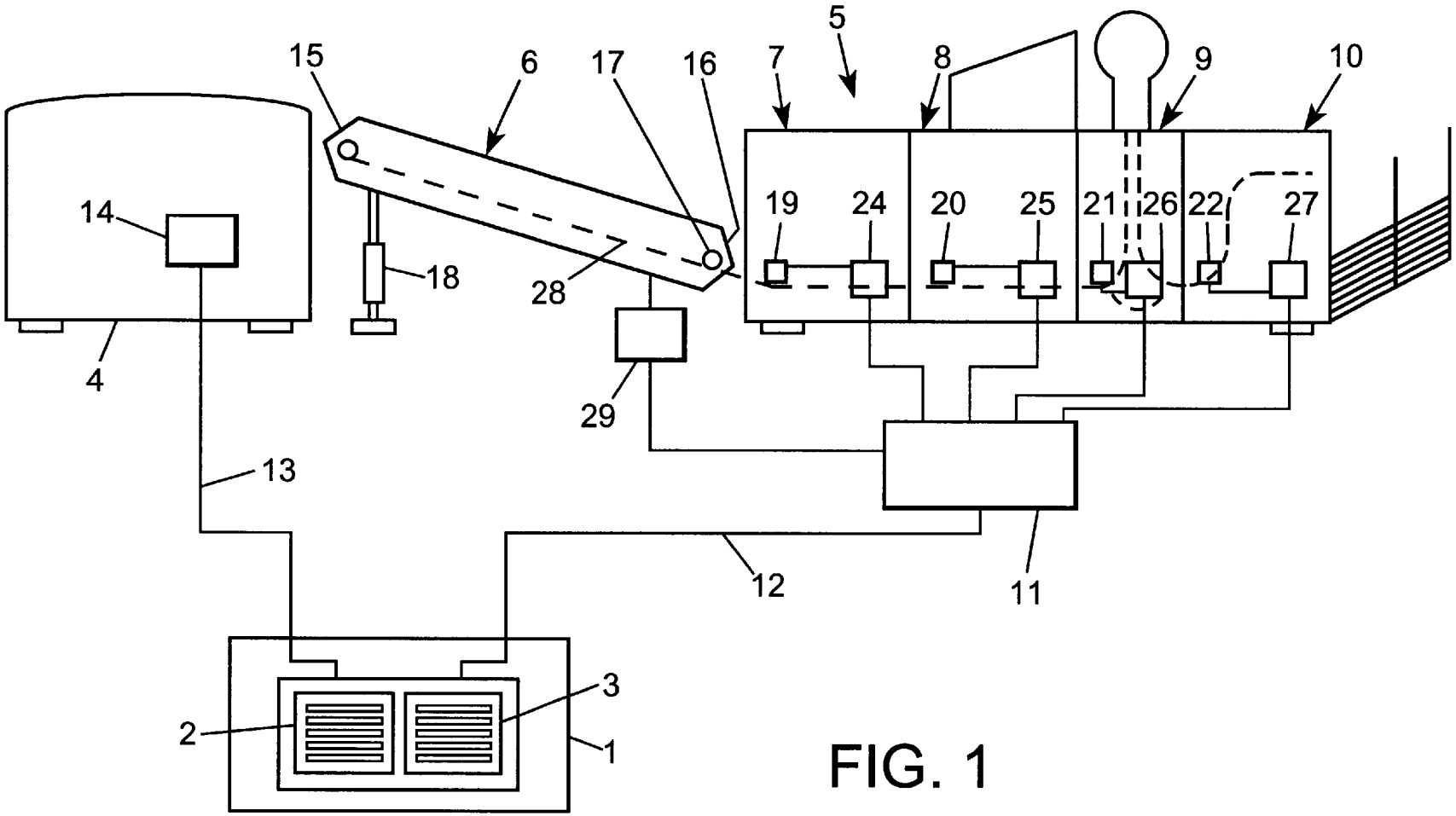
FIG. 1 is a diagrammatic representation of a system according to the invention.

FIG. 1 shows an example of a situation in which the invention can be employed with particular advantage. A computer system 1 includes data regarding the contents of documents, for instance in the form of a set of files 2 (optionally in conjunction with mail merge files) generated with a word processing or DTP system, and a set of finishing data 3 each associated with a file.

In the proposed situation, for printing and finishing the documents, there are provided a printer 4 of a generally commercially available type (what printer is chosen may conventionally depend on the requirements imposed regarding the printing possibilities and the capacity of the printer) and a finishing system. The finishing system in this example is an inserter system 5 which is made up of a buffer station 6, a collecting station 7, an insert feeder station 8, a folding station 9 and an inserter station 10.

However, other finishing systems, such as binding systems or packaging systems, may also be arranged downstream of the printer. Further, depending on the desired manufacturing method, instead of a printer a different device that dispenses documents, such as a reading device, a copying device, or a plastifying device, can be used.

For controlling the station, the finishing system is provided with a control unit 11 which communicates with the computer 1 via a connection 12. The computer 1 is further coupled with a control unit 14 of the printer 4 via a connection 13.

The printer 4, the collecting station 7, the insert feeder station 8, the folding station 9 and the inserter station 10 can be of a commercially available type. Printers and suitable finishing stations are commercially available from various providers. These parts are therefore not described in further detail here.

The buffer station 6 has an entrance 15, whose height is adjustable to the height of the exit of the printer 4 in that the buffer station 6 is pivotally mounted adjacent its exit 16, and in that it is provided, remote from and upstream of the pivot 17, with a height-adjustable support 18.

In order to produce the desired documents, the data regarding the contents of documents are converted into printing instructions in accordance with the requirements valid for the printer 4 in question. These printing instructions are then transmitted to the printer, where documents are printed in accordance with those printing instructions. Also, the associated data regarding the desired finish of the documents are converted into finishing instructions in accordance with the requirements dictated by the finishing system in question, which finishing instructions are transmitted to the control unit 11.

The control unit 11 and the stations 7–10 controlled thereby are arranged for carrying out finishing instructions according as documents arrive from the printer 4 in the stations 7–10 in question. To that end, the stations 7–10 are provided with path monitoring sensors 19–22, which are connected to control modules 24–27 of the corresponding stations 7–10. These control modules, in turn, are connected to the control unit 11, but may also be connected to each other, for instance for the direct upstream transmission of 'ready' reports. Optionally, the documents or interposed control documents may be provided with marks to ensure that each document is subjected to the correct finishing operations. It is also possible to determine the finishing instructions in their entirety by reading marks on the documents, so that communication between the computer 1 and the control unit 11 of the inserter system 5 can be dispensed with entirely.

The inserter system 5 and the buffer station 6 form a system for the in-line processing of flat objects, in this case sheets, received one by one from the upstream printer 4.

Through the system extends a transport path 28, while the buffer station 6 forms a buffer portion located upstream of the path monitors 19–22. The buffer station 6 too is provided with a control module 29, which is arranged for controlling different drives of the buffer station 6. The control modules 24–27, 29 and the control unit 11 form a control structure which is operatively connected to the transport path 28 for controlling the transport path 28.

This control structure and the buffer portion 6 are arranged for controlling the buffer portion of the transport path 28 such that flat objects are collected in the buffer station 6 in a configuration with a pitch in the direction of transport that is shorter than the dimensions of the corresponding flat objects in the direction of transport. Further, the buffer station is so arranged that, from that configuration, in the order in which the collected flat objects have been collected, the collected flat objects are moved away from each other and are further transported with mutual interspaces.

An example of the buffer station 6 will now be described with reference to FIGS. 2–7, representing different operating stages of a buffer station 6 and an adjacent, upstream portion of an inserter system 5.

The buffer portion of the transport path 28 is formed by two pairs of engagement surfaces 30, 31 and 32, 33, located opposite each other on opposite sides of the transport path 28. For the sake of clarity, in FIGS. 2–7 a gap is drawn between the surfaces 30, 31 and 32, 33 on opposite side of the transport path 28, but in practice opposite surfaces in the proposed example form a transport nip which is closed when no sheets or the like are disposed therebetween.

These transport nips are located between transport rollers 36, 37, whose external surfaces form two of the engagement surfaces 32, 33, and between transport belts 34, 35, whose circumferential surfaces form two others of the engagement surfaces 30, 31, and are spaced apart in the direction of transport. Further, rollers 38, 39 over which the transport belts 34, 35 pass, as well as the transport rollers 36, 37, are connected to a drive structure 40 for rotating those rollers 36–39 and thus moving the engagement surfaces 30–33. The design of such drives is generally known in this technical field and is therefore not further shown or described. The drive structure 40 is arranged for moving the surfaces 32, 33, which delimit a downstream one of the transport nips (between the rollers 36, 37) at a particular speed in the direction of transport, and for blocking, or moving at a lower, second speed in the direction of transport, the engagement surfaces 30, 31, which delimit a more upstream one of the transport nips discussed.

The entrance 15 of the buffer station is formed by a pair of feed-in rollers 41, 42. Further, just downstream of the feed-in rollers 41, 42, a sensor 43 is located for detecting the arrival of documents. Further located between the feed-in rollers 41, 42 and the transport belts 34, 35 are upper and lower paper guides 44, 45. The transport belts 34, 35, opposite the driven, downstream return rollers 38, 39, pass over upstream return rollers 46, 47. Located between the upstream return rollers 46, 47 and the downstream return rollers 38, 39 are pressure rollers 48, 49, whose positions in the direction of transport are adjustable as indicated by arrows 50, 51, 52, 53 (only in FIG. 2).

Located downstream of the buffer station 6 are paper guides 54, 55, which are located above a transport surface 56. Extending through slots (not visible in the drawing) in the transport surface 56 are transport fingers 57 which are movable in the direction of transport for passing sheets along the stations 7 and 8.

In operation, sheets dispensed by the printer are first received between the feed-in rollers 41, 42 and then, as soon as the leading edge has reached a position adjacent the sensor 43, detected. One by one, the sheets are dispensed by the printer and received between the feed-in rollers 41, 42. The pitch between successive specimens of the sheets, under normal circumstances, is always greater than or equal to the dimensions of the sheets in question in the direction of transport, so that the sheets do not overlap. As long as the inserter system 5 works with a shorter stroke time than does the printer 4, the sheets are transported by the buffer station to a delivery position and dispensed as soon as the collecting station 7 has issued a 'ready' signal. Thus at least a first specimen of the sheets is transported over at least some distance into the system.

As soon as a malfunction occurs in the inserter system 5, or if the printer 4 dispenses one or more sheets that can be printed very fast, the stroke time of the printer is temporarily shorter that that of the inserter system. In that case, sheets following the at least one leading specimen of the sheets are temporarily collected in the buffer station 6. In particular when using a printer in line with a downstream finishing system, in many cases the situation arises where, if, in response to a disturbance, the transport of a sheet in the downstream system 5 is stopped, the printer proceeds, with some delay, to cease dispensing sheets. The fact is that, in general, sheets in a printer (as a laser printer) are printed in accordance with sets of printing instructions each defining a printing of a page. If, in response to a disturbance, the printer is controlled for stopping the printing, at least one set of printing instructions being processed must be processed before the printing of specimens of the objects is stopped, because otherwise the printing process is disturbed, which would lead, for instance, to traces on the printed sheets. For this purpose, it is of importance that sheets can be collected and temporarily stored in a buffer stock between the printer 4 and the finishing system arranged in line therewith.

The temporary collection of the sheets occurs in a configuration with a pitch in the direction of transport, which is less than the dimensions in the direction of transport of the specimens of the sheets in question. This is represented in FIGS. 2–4.

Figure 6:
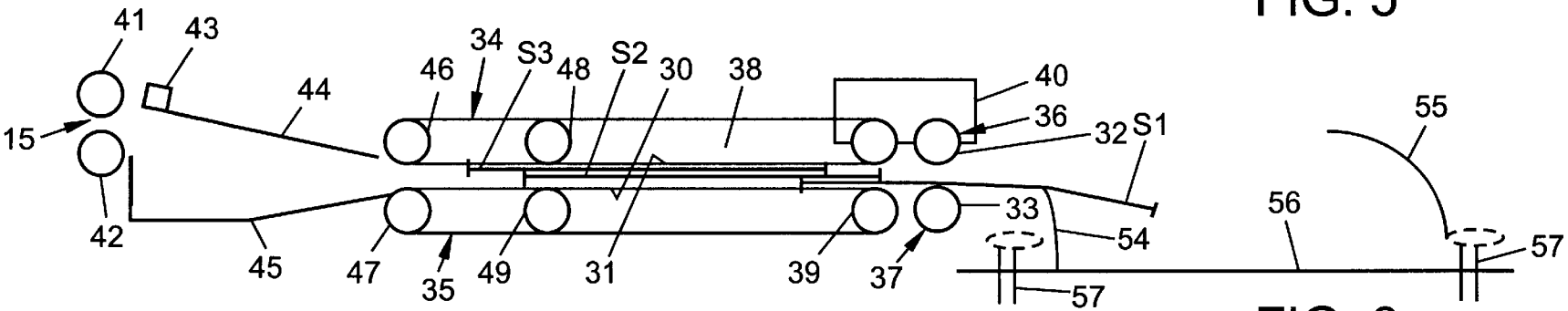
Figure 7:
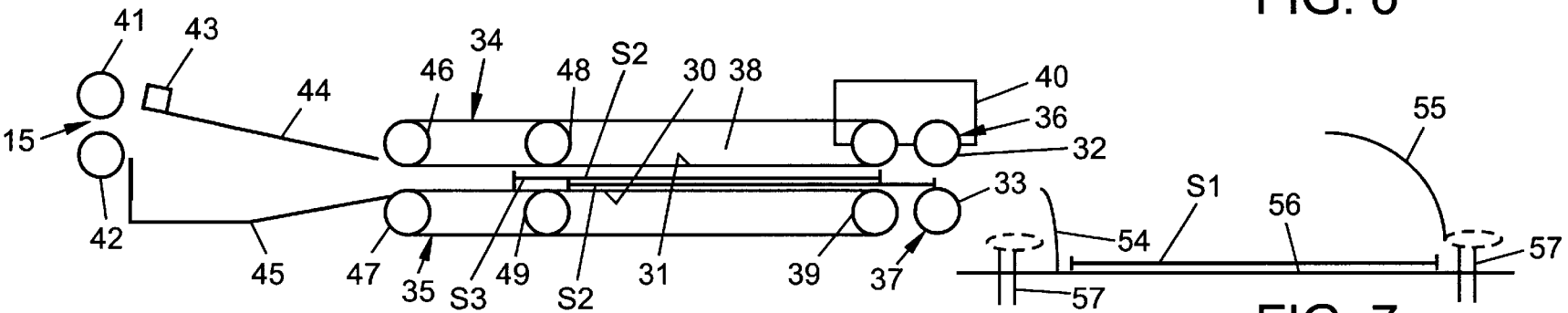

When the inserter system 5 operates faster again than the printer 4, for instance in that the malfunction has been removed or in that the printer is temporarily not provided with printing instructions, the collected sheets are subsequently moved away from each other from that configuration, in the order in which they have been collected, and transported further with mutual interspaces over the transport surface 56. This is represented in FIGS. 5–7.

Storing sheets or sets of sheets which are to be temporarily kept in a buffer stock, in a configuration staggered in the direction of transport but with a shortened pitch in the direction of transport, offers the advantage that on the one hand the buffer stock occupies little space in the direction of transport and that, on the other hand, the collected sheets or set of sheets, on the basis of their positions in the direction of transport, can easily be moved away from each other again when they are to be processed further. In particular, no separation system is needed, as is the case for separating sheets stored in a stack. Further, sheets belonging to each other can be discharged away from other sheets, even if they are not bonded together or do not exhibit any other mechanical form of coherence.

Figures 2, 3, 4:
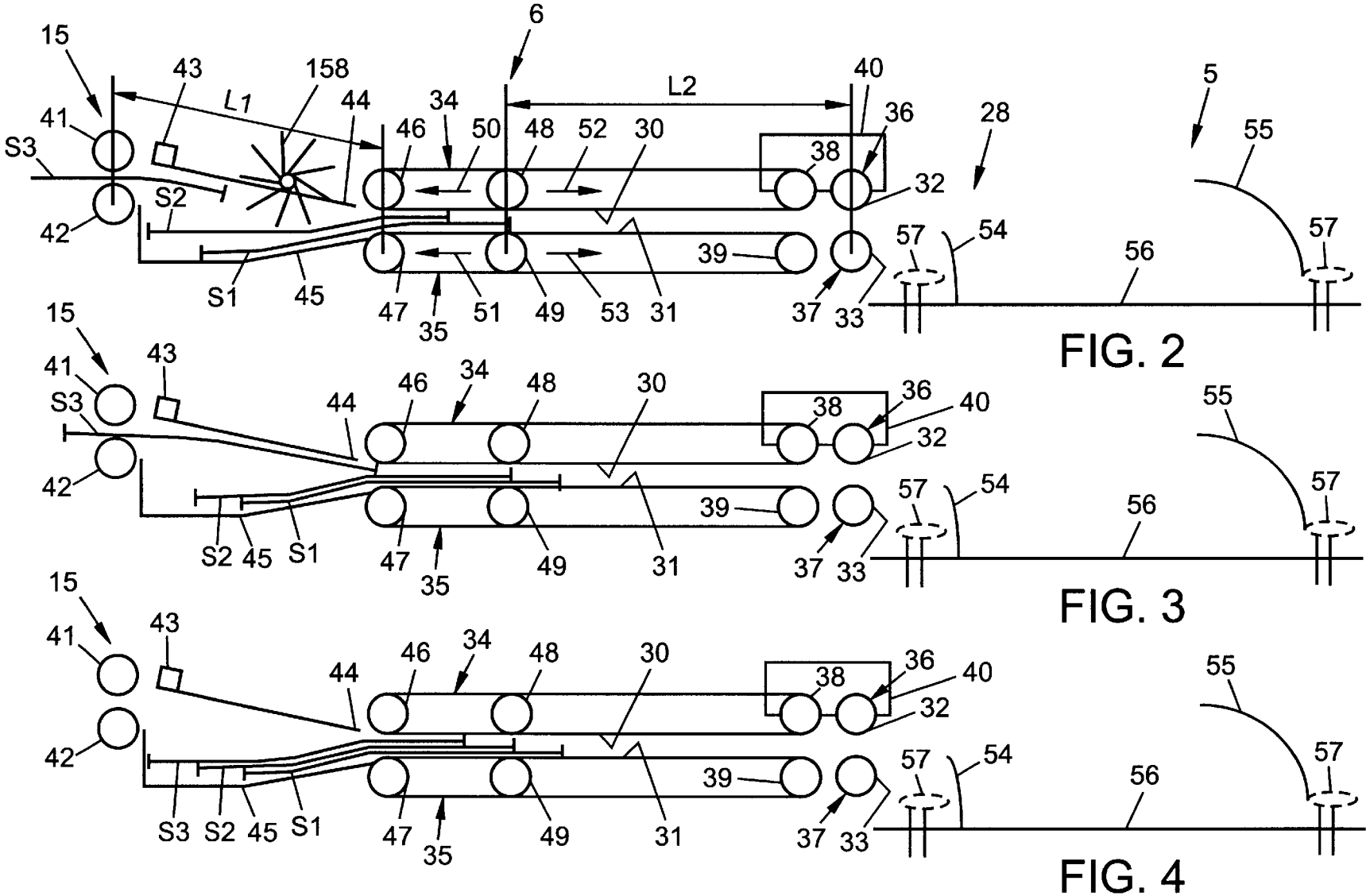
FIGS. 2–4 are side elevations of an upstream portion of a system according to the invention in successive operating stages during the buffering of flat objects.

As can be seen in FIGS. 2–4, the sheets are brought into a configuration where they overlap each other like roof-tiles, by moving the transport belts 34, 35 each time when a sheet reaches those belts, over just a distance that is less than the length of each of the sheets in the direction of transport. In FIGS. 2–4 this is shown for three. sheets $S_1$, $S_2$, and $S_3$. All this, as appears from the drawing, can be realized with a simple transport structure and the overlapping storage makes it possible to store a very great number of sheets without necessitating complex facilities for retaining the separate sheets or sets of sheets.

Figure 5:
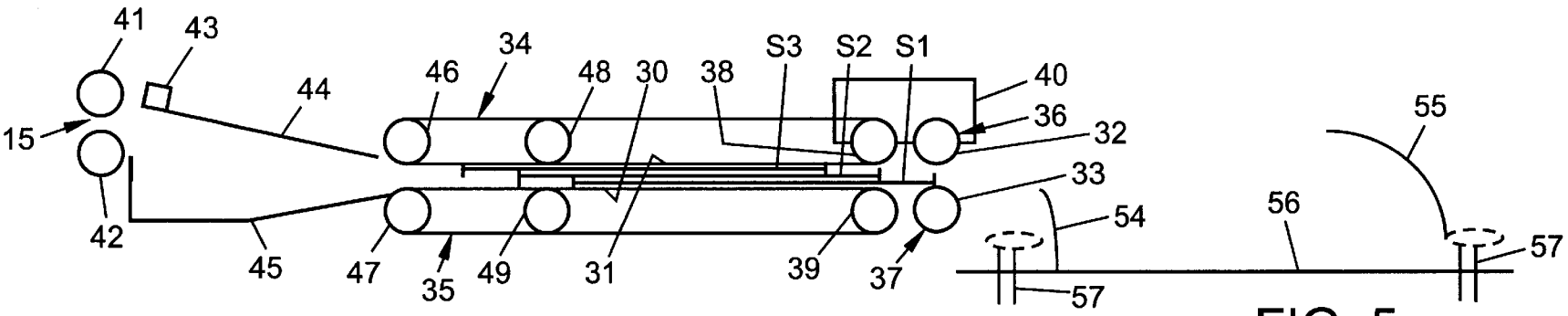
FIGS. 5–7 are diagrammatic side elevations similar to FIGS. 2–4 in successive operating stages as the flat objects are dispensed one by one.

As soon as the sheets $S_1$, $S_2$, $S_3$ can be dispensed again, the leading sheet S1 is carried into a delivery position, as is represented in FIG. 5. The transport rollers 36, 37, which form the downstream nip of the buffer station 6, are subsequently driven for dispensing the sheet $S_1$, as is represented in FIG. 6. When the sheet $S_1$ is clear of the transport rollers 36, 37, the next sheet $S_2$ is carried into the delivery position between the transport rollers.

The sheets can easily be moved away from each other again in that it is simple to accomplish that the downstream nip between the surfaces 32, 33 of the rollers 36, 37 engages exclusively a sheet or set of sheets to be dispensed.

A particularly reliable delivery of the sheets can be accomplished by holding the sheets at a distance L2 (see FIG. 2), which is greater than the length of the portion of a sheet or set of sheets to be dispensed, upstream of the nip between the surfaces 32, 33 of the rollers 36, 37, in a nip with a high normal force. This reliably prevents sheets from being carried along when preceding sheets are being dispensed. Those preceding sheets have already left the area or that nip, so that only those sheets are not retained by the normal force in that nip.

In the example shown in FIGS. 2–7, the nip for holding the sheets not yet to be dispensed is formed by the pair of rollers 48, 49 between the return rollers 38, 39, 46, 47 of the transport belts. Because the distance in the direction of transport between the transport nips between, on the one hand, the rollers 36, 37 and, on the other hand, the rollers 48, 49 is adjustable, that distance can be adapted to the length of the documents to be processed.

In principle, it is also possible, for the purpose of adjusting to the lengths of the sheets the site where sheets whose turn has not yet come are firmly held, when sheets are being dispensed, by the transport rollers 48, 49, to provide at least three successive transport nips (including the nip for dispensing sheets) and pressure means for selectively activating at least two upstream ones of those transport nips for generating a normal force for retaining sheets in the nip in question. Thus, selectively, in each case that nip can be activated for retaining sheets that is located at a distance from the transport rollers 39, 37 that corresponds with (is preferably just greater than) the length in the direction of transport of the sheets or sets of sheets to be processed.

The downstream return rollers 38, 39 of the transport belts 34, 35 form a third transport nip which is located in the direction of transport between the two transport nips between the roller pairs 36, 37 and 48, 49, This third transport nip is arranged for exerting less pressure and hence less traction on an object in that nip than do the nips located upstream and downstream thereof. This makes it possible to reliably displace sheets to be dispensed, over a distance L2 from the nip between the rollers 48, 49 to the nip between the delivery rollers 36, 37, which distance is longer than the length of the sheets to be processed.

Because the buffer station 6 is provided with endless transport belts 34, 35 which delimit the upstream transport nips between the rollers 38, 39, 46, 47, 48, 49, the sheets that are to be temporarily stored can be reliably retained. In particular, curling of the sheets and mutual relative displacement of sheets are thus effectively prevented.

The detector 43 for detecting received flat objects in the area of the entrance 15 is connected to the control module 29 and the control unit 11. These are arranged for operating the drive structure 40, such that in response to detection of a received sheet, the surfaces 30, 31 upstream of the transport nip between the delivery rollers 36, 37 are moved over a particular distance in the direction of transport. This distance determines the mutual pitch between sheets or sets of sheets that are stored between the transport belts 34. The moment at which detected sheets reach the transport belts 34, 35 is accurately controllable in that the distance L1 between the rollers 41, 42 which form the entrance 15 and the upstream return rollers 46, 47 of the transport belts 34, 35 is known and is less than the length of the sheets. The transport of sheets is thus taken over by the transport belts without the sheets being temporarily disposed uncontrolled between the rollers 41, 42 of the entrance and the transport belts 34, 35.

To increase the storage capacity of the buffer station 6, a sheet can, for instance between the transport belts 34, 35 and the delivery rollers 36, 37, be brought into an at least partly bent position, for instance by causing it to buckle. As a consequence, the trailing edge of that sheet can be transported further between the transport belts 34, 35 during the collection of sheets, so that between the transport belts 34, 35 more space is made available for temporarily storing sheets.

In some cases, the delay of the inserter system 5 with respect to the printer 4 is of such a temporary nature that the buffer station can receive a temporary excess of sheets and, after the cause of the delay has been removed, can dispense these again, without requiring the printing of sheets to be ceased or delayed. To stop or delay the printing of sheets only when such is unavoidable, the printer 4, after the collection of sheets in the buffer area formed by the transport belts 34, 35 has been started, may be actuated with a delay for stopping or delaying the feeding of documents. The delay of that actuation is then preferably chosen such that the residual capacity of the buffer area at the time of the actuation of the printer 4 to stop or delay the feeding of documents is sufficient for temporarily storing sheets that will still be dispensed after the actuation of the printer 4 to stop or delay the feed of sheets. The delay is preferably set depending on the properties of the printer 4 or the associated upstream device and the associated control software.

For achieving a high processing speed, it is advantageous if, in normal operation, sheets wait for a 'ready' report from the first station 7 of the inserter system 5 in a position in the buffer station 6 as far downstream as possible. A suitable position is, for instance, the position of the sheet $S_1$ as represented in FIG. 5, When the sheet $S_1$ is in that position (without the sheets $S_2$ and $S_3$ being present), it is, in principle, not possible anymore to have the transport belts 34, 35 run in the direction of transport for storing further sheets between them.

By displacing the sheet $S_1$ to a point beyond the normal delivery position, it is made possible in such a situation still to store sheets in the buffer area between the transport belts 34, 35.

This entails, however, that the leading edge of the sheet in the waiting position is also displaced in the direction of transport. If this is objectionable, for instance because it conflicts with the stationary portion of the transport path 28 downstream of the buffer station 6, it is possible, in response to a buffer indication, for a trailing edge of a sheet in the buffer area to be moved relative to the leading edge of that sheet in the direction of transport. This can be accomplished, for instance, by buckling, bending, rolling or tilting the sheet.

However, if such special measures are taken, the length of the sheet in the delivery position imposes limitations on the accommodating capacity of the buffer station 6. The storage capacity available under the most unfavorable circumstances can be increased to a particular extent in that, in response to a buffer indication (coming, for instance, from the control unit 11) indicating that sheets are to be temporarily stored in the buffer station 6, a sheet in the buffer area is displaced to a waiting position in the buffer area located upstream of the normal delivery position and subsequently, during the collection of sheets in the buffer area between the transport belts 34, 35, this sheet is transported with a delay with respect to the supply of further sheets to the buffer area in the direction of transport to maximally an extreme, downstream delivery position (this can be, for instance, the normal delivery position or a special delivery position located further downstream).

According to the actual position of a sheet between the transport belts 34, 35 at the moment when a buffer indication presents itself, the displacement to the waiting position of a sheet in the buffer area will occur in the direction of transport or against the direction of transport.

A favorable combination of an efficient transport under normal operating conditions and a great buffer capacity under special operating conditions is obtained if, as long as no sheets are being collected, the sheets are transported to the delivery position and, in response to a particular delivery signal, are dispensed from the delivery position, and if, in response to a buffer indication, a sheet is transported from the delivery position, against the direction of transport, to the waiting position.

The lower paper guide 45 upstream of the buffer area is formed such that downstream of the feed-in rollers 41, 42 a free parking space for accommodating trailing portions of dispensed sheets outside the transport path. Because the trailing portion of a sheet moves down relative to the entrance 15 into the parking space, a next sheet is prevented from butting against the trailing edge of a sheet already having a leading portion disposed between the transport belts 34, 35.

FIG. 2 further shows a deflector 158 for urging trailing portions of dispensed sheets into the parking space. This deflector 156 is designed as a brush wheel 158.

Hereinafter, a few alternative exemplary embodiments will be discussed, in which sheets or other flat objects, when being collected, are brought into an orientation at least partly tilted relative to the direction of transport.

Figure 8:
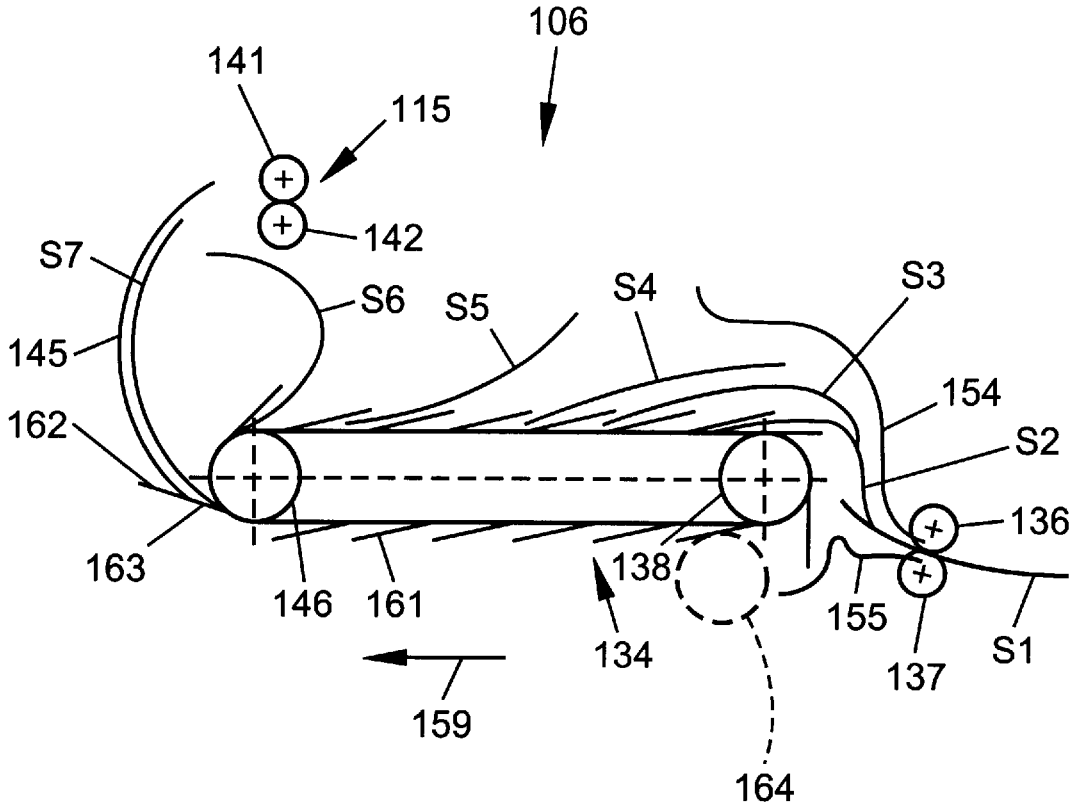
FIG. 8 is a diagrammatic side elevation of an upstream portion of a system according to a second exemplary embodiment of the invention.
Figure 9:
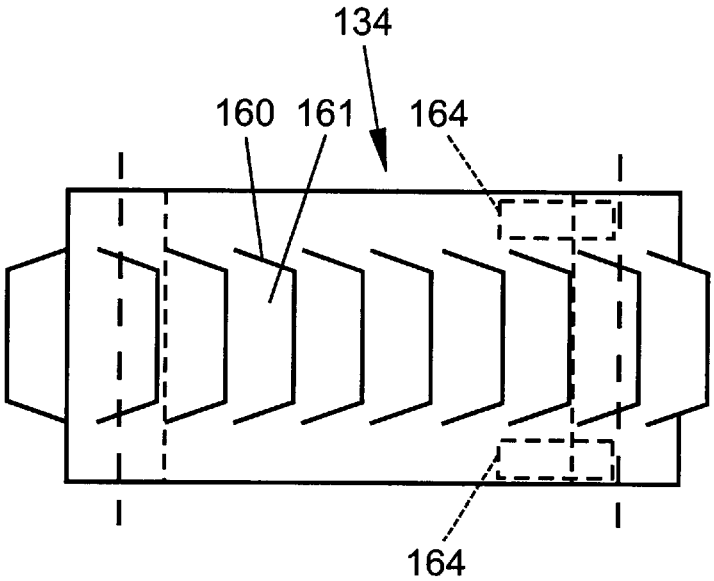
FIG. 9 is a diagrammatic top plan view of the system according to FIG. 8.

The buffer station 106 shown in FIGS. 8 and 9 has an entrance 115 between two transport rollers 141, 142. A paper guide 145 extends from the entrance 115 to an endless transport belt 134, which is movable in q direction indicated by an arrow 159. The transport belt is provided with U-shaped cuts 160, which form flaps 161. Further, the transport belt 134 is tensioned over return rollers 138, 146. Where the transport belt is bent over the return rollers 138, 146, the flaps 161 are bent away from the path of the belt 134 and, together with the path portion of the belt, form receiving recesses 162, each having a stop 163, for receiving a leading portion of a received sheet with a leading edge thereof in a position against the stop 163. When the base area of the flap 161 is tensioned in a straight position again, the flap is substantially closed again, so that a sheet received in the receiving recess 162 is clamped tight. At the end of the belt 134 remote from the paper guide 145, two further paper guides 154, 155 are arranged for guiding paper that is supplied while clamped behind a flap 161, to a pair of opposite delivery rollers 136, 137.

FIG. 8 shows a number of successive; stored sheets $S_1$–$S_7$. Upon entry via the entrance 115, a sheet is guided into one of the receiving recesses 162 until it butts against a stop 163 which is formed by the bottom of the receiving recess 162. The condition thus achieved is represented by sheet $S_7$.

Then the transport belt moves (further) in the direction indicated by the arrow 159. The received sheet is thereby tilted via the condition represented as sheet $S_6$ until the condition represented an sheet $S_4$ is achieved, in which the original trailing edge of a sheet forms the leading edge of that sheet and the sheet overlaps preceding sheets $S_2$, $S_3$.

While the transport belt 134 moves further, the sheet moves to the position represented as sheet $S_3$, in which the leading edge butts against the paper guide 154. Thereupon the new leading edge of a sheet is guided to the nip between the delivery rollers 136, 137 (position $S_2$). The delivery rollers 136, 137 thereupon engage the sheet, which is released by the belt 134 in that the receiving recess opens again when the base area of the flap 161 passes over the return roller 138 on the side of the exit and is thereby bent over. The sheet can now be dispensed in a controlled manner, as is represented by sheet $S_1$.

In principle, it is also possible to have the belt 134 run in the other direction. In that case, the leading edge of each sheet remains in leading position and it is released when a flap 161 by which the sheet is retained reaches the return roller 138 on the side of the exit (delivery rollers 136, 137), To pass the sheets from the belt 134 to the delivery rollers 136, 137, transport rollers 164 may be provided, which are represented by broken lines.

Figure 10:
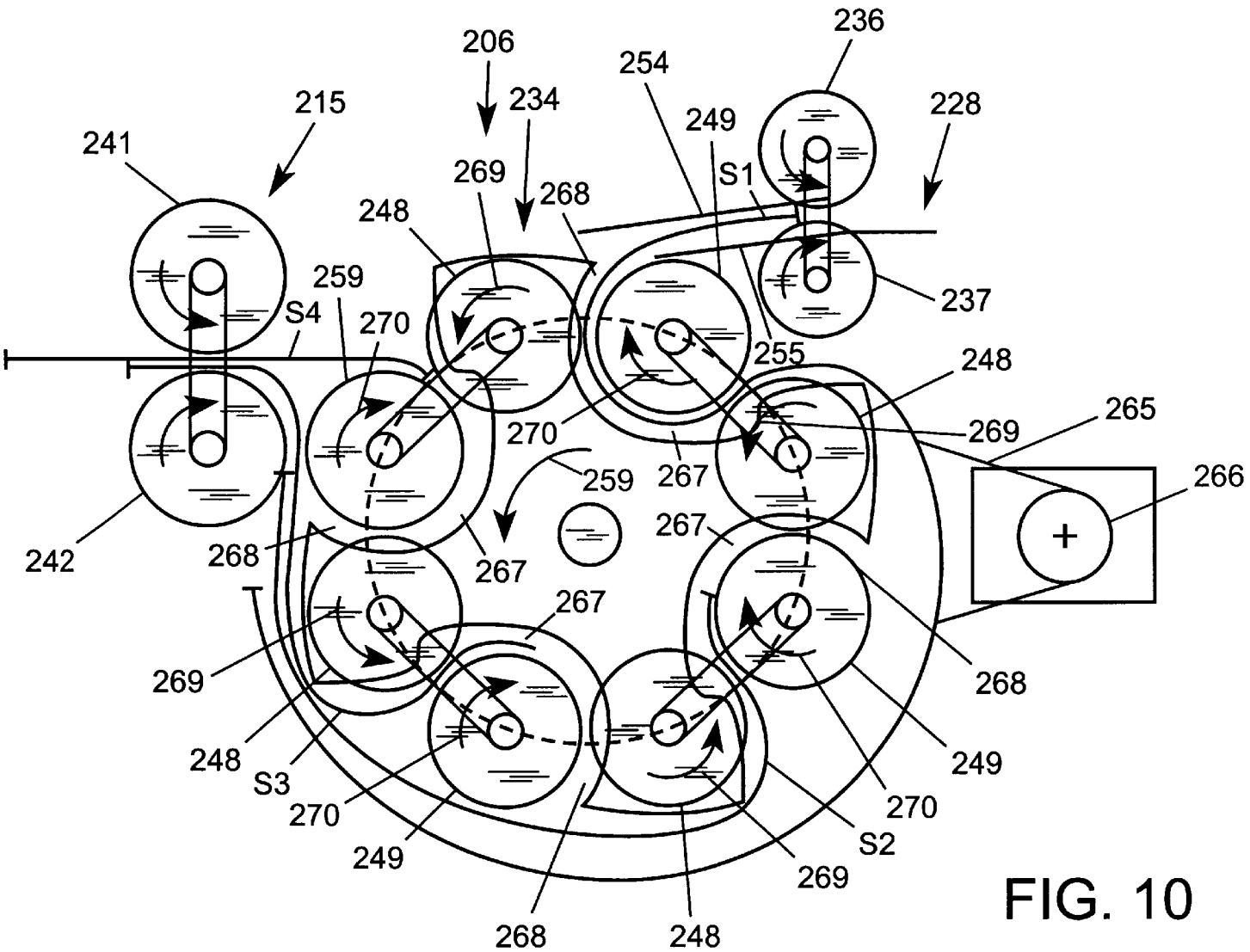
FIG. 10 is a diagrammatic side elevation of an upstream portion of a system according to a fourth exemplary embodiment of the invention.

FIG. 10 shows a further alternative exemplary embodiment of a buffer station 206 for use in a system according to the invention. This buffer station is provided with an entrance 215 between feed-in rollers 241, 242. The entrance terminates opposite a circulating transport element in the form of a rotor 234 which carries a number of roller pairs 248, 249 each having a transport nip between them, for receiving therebetween a leading portion of a received sheet. The rotor 234 is coupled via a drive belt 265 to a driving wheel 266 of a drive for rotating the rotor 234 in a direction of circulation (arrow 259). The rotor 234 further comprises a guide path 267 extending from the transport nips between the rollers 248, 249 around a downstream roller 249 of each roller pair, this guide path 267 having an exit 268 which, in the direction of circulation of the rotor 234, is located downstream of the associated roller pair 248, 249. The guide paths 267 each form a part of the transport path 228.

Further, the buffer station 206 comprises delivery rollers 236, 237 having a transport nip between them, and paper guides 254, 255 for guiding sheets into the area of the delivery rollers 236, 237.

The operation of the buffer station shown in FIG. 10 is illustrated on the basis of the processing of four sheets $S_1$, $S_2$, $S_3$, $S_4$ (of the sheet $S_4$, a trailing portion is not visible in the drawing). In operation, sheets arrive via the entrance 215 in the buffer station 206. The rotor is then located (moving or stationary) in a position in which the transport nip between a pair of the rollers 248, 249 is located opposite the entrance 215, so that the sheet runs into the transport nip as is indicated for a sheet $S_4$. Then the rotor 234 rotates further in the direction indicated by the arrow 259, while further the rollers 248, 249 are driven for rotation in the directions indicated by arrows 269, 270. The sheet having run into one of the transport nips between the rollers 248, 249 is thereby pulled further into that transport nip and further carried along in the direction of rotation by the rotation of the rotor 234. In the process, in succession the positions represented as sheets $S_3$, $S_2$ and $S_1$ are reached. The rotation of the rollers 248, 249 and of the rotor 234 are coupled to each other, such that the leading edge of each sheet reaches the exit 268 of the guide path 267 when the exit 268 is located opposite the transport nip between the delivery rollers 236, 237. The sheet in the position indicated by $S_1$ is thus transferred to the delivery rollers 236, 237. The rollers 248, 249 which are carried by the rotor are preferably provided with a freewheel clutch or a slip coupling, so that the sheets can be readily pulled from the transport nip between the rollers 248, 249 by the delivery rollers 236, 237. By rotating the rotor 234 between the arrival of successive sheets to a greater or lesser extent, the number of sheets in the buffer can be controlled, a maximum buffer being achieved when the rotor in each case brings a directly successive pair of the rollers 248, 249 opposite the entrance for receiving a sheet.

What is claimed is:

1. A method for in-line processing flat objects, comprising:

feeding the objects from a device;

serially transferring at least one leading specimen of the objects to a system for processing serially received flat objects with a pitch between successive specimens of the objects which is greater than or equal to the dimensions in the direction of transport of the specimens in question of the objects;

transporting said at least one leading specimen of the objects in said system; and temporarily collecting at least two specimens of the objects that follow said at least one leading specimen of the objects, wherein temporarily collecting said at least two specimens of the objects occurs in a configuration staggered with respect to each other in the direction of transport with a pitch in the direction of transport, which pitch is smaller than the dimensions in the direction of transport of the specimens in question of the objects; and the collected specimens of the objects are subsequently moved away from each other, from said configuration, in the order in which these specimens of the objects have been collected, and are further transported with mutual interspaces;

wherein, in response to a buffer indication, the transport of a specimen of the objects in said system is stopped and subsequently, with some delay, the feeding of specimens of the objects from said device is stopped.

2. A method according to claim 1, wherein specimens of the objects, when being collected, are brought into a configuration where they overlap like roof-tiles.

3. A method according to claim 1, wherein specimens of the objects are printed in said device in accordance with sets of printing instructions each defining a printing of a page, wherein, in response to a buffer indication, said device is actuated for stopping or delaying the printing and wherein subsequently the printing in accordance with at least one set of printing instructions being processed is completed before the printing of specimens of the objects is stopped or delayed.

4. A method for in-line processing flat objects, comprising:

feeding the objects from a device;

serially transferring at least one leading specimen of the objects to a system for processing serially received flat objects with a pitch between successive specimens of the objects which is greater than or equal to the dimensions in the direction of transport of the specimens in question of the objects;

transporting said at least one leading specimen of the objects in said system; and temporarily collecting at least two specimens of the objects that follow said at least one leading specimen of the objects, wherein temporarily collecting said at least two specimens of the objects occurs in a configuration staggered with respect to each other in the direction of transport with a pitch in the direction of transport, which pitch is smaller than the dimensions in the direction of transport of the specimens in question of the objects; and the collected specimens of the objects are subsequently moved away from each other, from said configuration, in the order in which these specimens of the objects have been collected, and are further transported with mutual interspaces;

wherein, after collecting specimens of the objects in a buffer area has been started, said device is actuated with a delay for stopping or delaying the feeding of documents, said delay of the actuation being selected such that the residual capacity of the buffer area at the moment of the actuation of said device to stop or delay the feeding of documents is sufficient for temporarily storing specimens of the objects which are still fed after the actuation of said device and prior to the stopping or delaying of the feeding of objects.

5. A method according to claim 4, wherein specimens of the objects, when being collected, are brought into a configuration where they overlap like roof-tiles.

6. A method for in-line processing flat objects, comprising:

feeding the objects from a device;

serially transferring at least one leading specimen of the objects to a system for processing serially received flat objects with a pitch between successive specimens of the objects which is greater than or equal to the dimensions in the direction of transport of the specimens in question of the objects;

transporting said at least one leading specimen of the objects in said system; and temporarily collecting at least two specimens of the objects that follow said at least one leading specimen of the objects, wherein temporarily collecting said at least two specimens of the objects occurs in a configuration staggered with respect to each other in the direction of transport with a pitch in the direction of transport, which pitch is smaller than the dimensions in the direction of transport of the specimens in question of the objects; and the collected specimens of the objects are subsequently moved away from each other, from said configuration, in the order in which these specimens of the objects have been collected, and are further transported with mutual interspaces;

wherein, in response to a buffer indication, a specimen of the objects in the buffer area is transported to a waiting position in the buffer area and wherein during the collection of specimens of the objects in the buffer area, this object is transported with a delay with respect to the supply of specimens of the objects to the buffer area, in the direction of transport to maximally an extreme, downstream delivery position.

7. A method according to claim 6, wherein said displacement to the waiting position of a specimen of the objects in the buffer area occurs, depending on the position of that object, in the direction of transport or against the direction of transport.

8. A method according to claim 7, wherein, in an operating condition in which no objects are collected, specimens of the objects are transported to said delivery position and, in each case in response to a particular delivery signal, are dispensed from that delivery position, and wherein, in response to a buffer indication, a specimen of the objects is transported from said delivery position, against the direction of transport, to said waiting position.

9. A method according to claim 6, wherein specimens of the objects, when being collected, are brought into a configuration where they overlap like roof-tiles.

10. A system for in-line processing flat objects serially received from an upstream device, comprising:

a transport path having an entrance for serially receiving flat objects coming from an upstream system, having a path monitoring and having a buffer portion upstream of the path monitoring; and control means operatively connected to the transport path for controlling the transport path, wherein the control means and the buffer portion are arranged for controlling the buffer portion of the transport path, such that flat objects in the buffer portion are collected in a configuration staggered with respect to each other in the direction of transport, with a pitch in the direction of transport which is shorter than the dimensions in the direction of transport of the flat objects in question, and for moving the collected flat objects away from each other, from said configuration, in the order in which the collected flat objects have been collected, and transporting the collected flat objects further with mutual interspaces;

wherein the buffer portion of the transport path comprises at least two pairs of engagement surfaces located opposite each other on opposite sides of the transport path, each forming a transport nip for engagement of flat objects therebetween, said transport nips being spaced apart in the direction of transport, and said engagement surfaces being connected to a drive structure for moving at least one of said engagement surfaces which delimits a downstream one of said transport nips at a first speed in the direction of transport and for blocking or moving at a lower, second speed in the direction of transport at least one of said engagement surfaces which delimits a more upstream one of said transport nips.

11. A system according to claim 10, wherein the distance in the direction of transport between said transport nips is adjustable.

12. A system according to claim 10, further comprising at least three of said transport nips, and pressing means for selectively activating at least two upstream ones of said transport nips for generating a normal force for retaining flat objects in the nip in question.

13. A system according to claim 10, further comprising at least one endless transport belt which delimits at least one upstream one of said transport nips.

14. A system according to claim 10, further comprising a detector for detecting received flat objects in the area of said entrance, which detector is operatively connected to said control means, said control means being arranged for operating the drive structure such that in each case in response to detection of a received flat object at least one surface which delimits at least one upstream one of said transport nips is moved over a particular distance in the direction of transport.

15. A system according to claim 10, further comprising at least one third transport nip between said two transport nips for engagement of flat objects therebetween, said third transport nip being arranged for exerting less traction on an object in the nip than said nips located upstream and downstream thereof.

16. A system for in-line processing flat objects serially received from an upstream device, comprising:

a transport path having an entrance for serially receiving flat objects coming from an upstream system, having a path monitoring and having a buffer portion upstream of the path monitoring; and control means operatively connected to the transport path for controlling the transport path, wherein the control means and the buffer portion are arranged for controlling the buffer portion of the transport path, such that flat objects in the buffer portion are collected in a configuration staggered with respect to each other in the direction of transport, with a pitch in the direction of transport which is shorter than the dimensions in the direction of transport of the flat objects in question, and for moving the collected flat objects away from each other, from said configuration, in the order in which the collected flat objects have been collected, and transporting the collected flat objects further with mutual interspaces;

a free parking space, for receiving trailing portions of fed flat objects outside the transport path; and a deflector upstream of said entrance for bringing trailing portions of fed flat objects into said parking space outside the transport path.

* * * * *